US005079791A

United States Patent [19]

Grech

[11] Patent Number: 5,079,791

[45] Date of Patent: Jan. 14, 1992

[54] TOOL FOR SNAP FASTENERS

[76] Inventor: George J. Grech, 44005 Southampton, Canton, Mich. 48187

[21] Appl. No.: 582,993

[22] Filed: Sep. 14, 1990

Related U.S. Application Data

[63] Continuation of Ser. No. 371,199, Jun. 26, 1989, abandoned.

[51] Int. Cl.[5] ..... B25F 1/00

[52] U.S. Cl. ..... 7/169; 81/3.55; 29/267

[58] Field of Search ..... 7/151, 161, 169, 170; 81/900, 3.55; 29/267; 254/25, 28

[56] References Cited

U.S. PATENT DOCUMENTS

| | | | |
|---|---|---|---|
| 626,722 | 6/1899 | Pusey . | |
| 734,157 | 7/1903 | Bernard . | |
| 1,044,551 | 11/1912 | Lynch . | |
| 1,139,938 | 5/1915 | Weinstein . | |
| 2,228,360 | 1/1941 | Nordeck . | |
| 2,445,761 | 7/1948 | Castle . | |
| 2,759,383 | 8/1956 | Mrazik | 7/151 X |
| 3,250,450 | 5/1966 | LePage et al. . | |
| 3,296,899 | 1/1967 | Portanova . | |
| 3,616,827 | 11/1971 | Stilluagon | 81/900 X |
| 3,874,578 | 4/1975 | Derr et al. . | |
| 3,923,229 | 12/1975 | Kruger . | |
| 3,984,041 | 10/1976 | LePage et al. . | |
| 3,988,996 | 11/1976 | Jasper . | |
| 4,524,646 | 6/1985 | Kimberlin | 81/3.55 |
| 4,694,550 | 9/1987 | Grove | 29/267 |

FOREIGN PATENT DOCUMENTS

| | | | |
|---|---|---|---|
| 183821 | 3/1923 | United Kingdom | 7/151 |

*Primary Examiner*—James G. Smith

*Attorney, Agent, or Firm*—Gifford, Groh, Sprinkle, Patmore and Anderson

[57] ABSTRACT

A tool for unsnapping a snap fastener from and reattaching a snap fastener to a snap fastener base. The tool includes a wedge-shaped unsnapping end and a reattaching end having a recessed area for locating and pressing upon the head of a snap fastener. The unsnapping end includes a U-shaped slot having inclined interior walls. The unsnapping end is coated with a resilient, scratch-preventive plastic coating. The recessed area of the reattaching end is composed of a hard rubber. The tool may be composed of a plastic.

3 Claims, 1 Drawing Sheet

18
20
24
16
22

20
22
24
16
12
26
10
28

18
20
16
22

36
38
20
12
26
16
10
28
30
34
14

22
20
34
14
24
16
18
28
10
26
12

20
16
10
28
26
12
38
36

TOOL FOR SNAP FASTENERS

This is a continuation of copending application Ser. No. 07/371,199 filed on June 26, 1989 now abandoned.

BACKGROUND OF THE INVENTION

I. Field of the Invention

The present invention relates generally to tools for snap fasteners. More particularly, the present invention relates to tools for unsnapping a snap fastener from and reattaching a snap fastener to a snap fastener base.

II. Description of the Relevant Art

The conventional snap fastener includes two parts. The first part is a round snap fastener base which is fixed to a surface by means of a rivet, screw or a nut and bolt placed through a central aperture provided in the snap fastener base. The second part is the snap fastener body which is snappingly fastenable to the base and is held in place thereon by a resilient, expandable split ring provided within the snap fastener body. The body is conventionally attached to a covering material of some type. When so attached, the fastening portion is on the "inside" of the material and the snap fastener head is on the "outside" of the material.

Snap fasteners are widely used, and their use generally relates to a covering of some type. Such coverings typically include applications such as boat covers and canopies or trailer coverings or tarps. Usage for trailer coverings includes both commercial truck trailers and consumer camping trailers. Use of snap fasteners has also been employed in automobile convertible tops and tonneau covers.

While easy to construct and attach to a body, conventional snap fasteners have traditionally been susceptible to wear and tear at the fastener body. To unsnap the fastener, the individual often grabs the associated cloth or plastic material and by applying a sufficient amount of removing force, simply pulls on the material itself to unsnap the fastener.

The result of such pulling force is often torn or worn material. Once the material around the fastener body is torn or damaged, the fastener body cannot be reinforced or reattached to the material. The undesirable result of such wear is that a new cover will have to be purchased, which is usually a very costly end.

Oftentimes, if a fastener body is difficult to unsnap from its base, the remover resorts to a prying tool for unsnapping. The principal of employing a tool is sound, but the tool available—the conventional screwdriver—does more harm than good. In using a screwdriver, the user invariably damages the surface to which the fastener base is attached or tears or punctures the material to which the fastener body is attached.

While reattachment of the snap fastener body to the fastener base is conventionally accomplished by pressing the thumb upon the head of the fastener, this method is not always successful in that fastening may sometimes be frustrated by a rusty or bent fastener base or body. Unfortunately, known methods of overcoming such resistance include the undesirable choice of banging upon the head of the fastener with a tool such as a hammer. The undesirable results include a substantially flattened fastener head.

Accordingly, the prior approaches to solving the problems of unsnapping snap fastener bodies from snap fastener bases and returning them thereto have failed to eliminate the inconvenience and inefficiency of known methods.

SUMMARY OF THE PRESENT INVENTION

The present invention provides a tool for unsnapping a snap fastener from and reattaching a snap fastener to a snap fastener base. The tool includes a wedge-shaped unsnapping end and a reattaching end having a recessed area for locating and pressing upon the head of a snap fastener. The unsnapping end includes a U-shaped slot having inclined interior walls.

The unsnapping end is coated with a resilient, scratch-preventive plastic coating. The recessed area of the reattaching end is composed of a hard rubber. The recessed area itself is hemispherically concave. The tool may be composed of a plastic or a metal.

By the present invention, removal of a snap fastener body from a snap fastener base is accomplished by insertion of the unsnapping end between the body to which the base is fixed and the material to which the fastener body is fixed. The gentle slope of the wedge urges the fastener body away from the fastener base, and the inclined interior walls of the U-shaped slot urge against the fastener body (which overlies the fastener base) to assist in removal. Because the unsnapping end is coated, the body to which the base is fixed is not marred by the removing action. Because the slope is gentle, no damage to either the snap fastener base or body is inflicted. The cloth or plastic material also remains undamaged.

To reattach a snap fastener body to a snap fastener base, the body is aligned over the base and the recessed area of the reattaching end is aligned over the head of the fastener body. A slight pressure is applied, and fastening is thereby accomplished. Because the recessed area is composed of a hard rubber, no damage results to the fastener head.

In addition to the above-stated advantages, the tool according to the present invention can be manufactured at a relatively low cost.

Other advantages of the present invention will become more apparent from the following description which more fully discloses the various attributes of the present invention.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENT OF THE PRESENT INVENTION

Figures 1, 2, 3, 4, 5, 6:
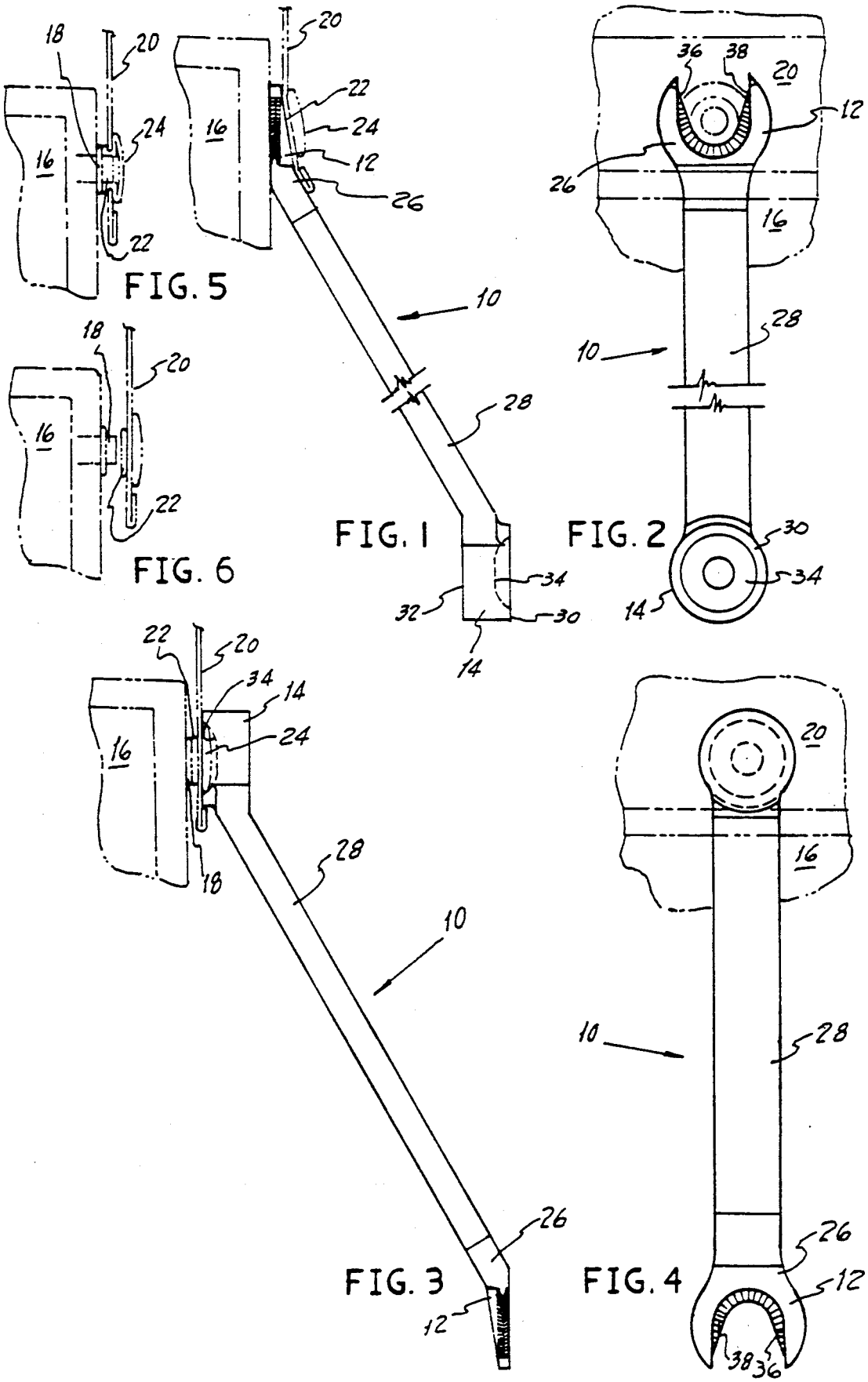
FIG. 1 is a side elevational view of a snap fastener tool according to the present invention in place for unsnapping a fastener.
FIG. 2 is a top plan view of the view of FIG. 1.
FIG. 3 is a side elevational view of the fastener of the present invention in place over the head of a fastener body for reattachment of the fastener body to a fastener base.
FIG. 4 is a top plan view of the view of FIG. 3.
FIG. 5 is a partial view of the fastener body in place on a fastener base.
FIG. 6 is the same view as FIG. 5 except illustrating the fastener body unfastened from the fastener base.

The drawing discloses the preferred embodiment of the present invention. While the configuration according to the illustrated embodiment is preferred, it is envisioned that alternate configurations of the present invention may be adopted without deviating from the invention as portrayed. The preferred embodiment is discussed hereafter.

FIGS. 1 and 2 illustrate a snap fastener tool according to the present invention, generally indicated as 10. The tool 10 includes a snap fastener unsnapping end 12 and a snap fastener reattaching end 14. These figures illustrate the use of the tool 10 for unsnapping a snap fastener.

With particular reference to FIG. 1, a side elevational view of the tool 10 is shown.

The tool 10 may be composed of a polymerized material such as a rigid plastic or may be composed of a metal such as aluminum.

The unsnapping end 12 is wedge-shaped for sliding between a fixed body 16 to which a fastener base 18 (illustrated in FIGS. 5 and 6) is attached and the combination of a stretch of material 20 through which a fastener body 22 (illustrated in FIGS. 5 and 6) having a fastener body head 24 is attached.

The wedge shape of the end 12 depicts a gradual slope for gently urging the snap fastener body 22 away from the snap fastener base 18. The unsnapping end 12 is preferably coated with a resilient, scratch-preventive plastic coating 26. The coating 26 provides protection against possible scratching or marring of a finished surface of the fixed body 16.

An intermediate portion 28 of the tool 10 functions as a handle for grasping and pressing. The intermediate portion 28 forms an angular offset between the unsnapping and reattaching ends 12 and 14, such that said first and second means lie in different parallel planes. The offset permits both the unsnapping and reattaching ends 12 and 14 to be applied to a material without interference from the user's hand as it grasps the fastener tool 10. The offset further enables greater leverage to be applied when unsnapping or reattaching a fastener body 22 from a fastener base 18. The angular offset preferably forms co-equal angles between the intermediate portion 28 and the unsnapping and reattaching ends 12 and 14, respectively. With the tool 10 in place as shown in FIG. 1, a mere sliding motion of the tool 10 between the fixed body 16 and the material 20 should effect unsnapping.

The reattaching end 14 has a first side 30 and a second side 32. Defined on the first side 30 is a hemispherically concave recessed area 34. The area 34 is preferably composed of a firm, polymerized material such as a hard rubber. This composition provides a firm base for providing necessary force for reattachment of a fastener (as will be discussed below with respect to FIGS. 3 and 4) while concurrently providing a scratch-preventive surface.

With reference to FIG. 2, a top plan view of the positions of the tool 10 shown in FIG. 1 is illustrated. This view aids in illustrating the general width of the intermediate portion 28 for grasping. Also understandable by this view is the construction of the reattaching end 14.

The unsnapping end 12 has defined therein a U-shaped fastener receiving slot 36. The slot 36 pilots the fastener assembly (the fastened body 22 and base 18) therein by the illustrated U-shape having a slightly flared opening.

The slot 36 defines an interior wall 38. The wall 38 is slightly inclined for gently urging the fastener body 22 away from the fastener base 18. The inclined interior wall 38 slides into the slit defined at the intersection of the body 22 and the base 18 upon the unsnapping maneuver.

FIGS. 3 and 4 illustrate use of the tool 10 for reattachment of the fastener body 22 to the fastener base 18. The tool 10 is merely reversed from its unsnapping position illustrated in FIGS. 1 and 2.

With particular reference to FIG. 3, a side elevational view of the tool 10 is illustrated. The reattaching end 14 is shown in place over the head 24 of the fastener body 22. As illustrated, the tool 10 has been already used to apply force to the head 24, as the body 22 is already attached to the base 18.

The fastening end 14 is shown in partial cross-section to illustrate the hemispherically concave shape of the recessed area 34. The concave shape of the recessed area 34 matches the shape of the fastener body head 24 so as to provide contact with the head 24 surface. Reattaching forces are equally applied to the head 24 by the reattaching end 14 to effect reattachment of the fastener head 24 with the fastener base 18. This shape assists in locating the center of the fastener head 22, which itself is slightly arcuate, to the center of the recessed area 34.

FIG. 4 illustrates a top plan view of the view of FIG. 3. This view better illustrates how the fastening end 14 locates the center of the fastener head 22 for applying fastening pressure thereupon.

With reference to FIG. 5, the construction of the fastener body 22 in its attached position to fastener base 18 is illustrated. This view reveals more clearly the parts of the fastener assembly waiting to be unsnapped by the tool 10.

FIG. 6 is the same view as FIG. 5, except that the fastener body 22 has been detached from the fastener base 18. This is substantially the appearance of the assembly prior to being reattached by the tool 10.

Having described by invention, however, many modifications thereto will become apparent to those skilled in the art to which it pertains without deviation from the spirit of the invention as defined by the scope of the appended claims.

I claim:

1. A tool for unsnapping a snap fastener body from and reattaching a snap fastener body to a snap fastener base said tool comprising:

an elongated body portion, said body portion including a first means for unsnapping said snap fastener body from said snap fastener base;

said first means comprising an end slot and a wedge shaped surface defining the edge of said slot, said wedge shaped surface being adapted to fit between said snap fastener body and said snap fastener base to bear against and to urge said snap fastener body to separate from said snap fastener base as said tool slid is moved toward said snap fastener base;

said wedge shaped surface being angularly offset with respect to said elongated body portion to aid in moving said wedge shaped surface in position between said snap fastener body and said snap fastener base;

said body portion further including a second means at the end of said body portion opposite from said first means for reattaching said snap fastener body to said snap fastener base;

said second means comprising an upper surface and a lower surface extending from the end of said elongated body portion and offset from the longitudinal axis thereof;

said offset between said first and second means being formed by said elongated body portion being connected in like angular fashion to said first and second means, such that said first and second means lie in different parallel planes;

said lower surface forming a substantially hemispheric concave recess adapted to fit over and match said snap fastener body so as to urge engagement of said snap fastener body with said snap fastener base upon movement of said tool downward over said snap fastener body, the offset relationship between the elongated body portion and said second means facilitating the necessary movement of said tool to accomplish reattachment of said snap fastener body to said snap fastener base; and said wedge shaped surface of said first means and said lower surface of said second means being of a material softer than said snap fastener base.

2. The tool according to claim 1 wherein said first means is coated with a resilient, scratch-preventive polymerized coating.

3. The tool according to claim 1 wherein said recessed area is composed of a firm, polymerized material, said polymerized material is a hard rubber.

* * * * *